US005908342A

United States Patent [19]

Wolvin

[11] Patent Number: 5,908,342

[45] Date of Patent: Jun. 1, 1999

[54] THREE DIMENSIONAL CONNECTOR

[75] Inventor: Brian Wolvin, Ste. Anne de Bellevue, Canada

[73] Assignee: 3160840 Canada Inc., Mississauga, Canada

[21] Appl. No.: 08/915,718

[22] Filed: Aug. 21, 1997

[51] Int. Cl.[6] ..... A63H 33/04

[52] U.S. Cl. ..... 446/124; 273/160; 403/171; 446/85

[58] Field of Search ..... 446/122, 124, 446/125, 126, 128, 85; 273/156, 160, 153 S; 403/171, 76, 169, 217, 340

[56] References Cited

U.S. PATENT DOCUMENTS

| | | | |
|---|---|---|---|
| 2,902,821 | 9/1959 | Kelly, Jr. | 59/80 |
| 2,977,701 | 4/1961 | Louderback | 273/160 |
| 3,252,287 | 5/1966 | Suzuki | 61/5 |
| 3,562,077 | 2/1971 | Raba | 161/14 |
| 3,577,660 | 5/1971 | Kenney . | |
| 3,597,874 | 8/1971 | Ogsbury et al. | 46/25 |
| 3,626,632 | 12/1971 | Bullock, Jr. | 46/25 |
| 4,148,489 | 4/1979 | Pidgeon | 273/160 |
| 4,160,609 | 7/1979 | Jackson et al. | 403/340 |
| 4,740,188 | 4/1988 | Coster | 446/114 |
| 4,890,952 | 1/1990 | Jones | 403/217 |
| 4,892,484 | 1/1990 | Brown et al. | 434/259 |
| 4,930,930 | 6/1990 | Coppa | 403/171 |
| 5,097,645 | 3/1992 | Sanderson | 403/171 |
| 5,137,486 | 8/1992 | Glickman | 446/126 |
| 5,322,467 | 6/1994 | Barzani | 446/125 |

*Primary Examiner*—Robert A. Hafer
*Assistant Examiner*—Laura Fossum
*Attorney, Agent, or Firm*—Bereskin & Parr

[57] ABSTRACT

A multi-pointed three dimensional connector has a first planar element having a plurality of radially extending arms, a second planar element having a plurality of radially extending arms, a first locking member defined by the interengagement the first and second elements and a second locking member to secure the first and second elements together.

18 Claims, 5 Drawing Sheets

THREE DIMENSIONAL CONNECTOR

FIELD OF THE INVENTION

The present invention relates to a three dimensional connector which is assembled from a plurality of individual elements. In one embodiment, the connector may be used as a connector in a toy construction set to connect together other such elements or elements which are adapted to be connected to the connector. Alterantely, it may be used as an isometric space fame such as in the construction industry.

BACKGROUND TO THE INVENTION

Different types of connector elements may be used to construct isometric space frames. Such frames have a variety of uses. One area which uses such elements are construction toys. The connector of this invention will be described with reference to a connector for a toy construction set but it may also be used to construct an isometric space frame or the like of any size and for any purpose. Generally, connector elements have radially extending struts for receiving interconnecting elements. A plurality of connector elements may be joined together through interconnecting elements to form a structure. This type of construction toy is desirable, because it encourages coordination and creativity in children.

For example, U.S. Pat. No. 5,137,486 to Glickman discloses a connector element for a construction toy which, when assembled, provides for connection in separate planes which are at right angles to one another. The stated advantage of this design is that it allows two independent, similarly shaped, flat connecting elements to be joined together to form the three dimensional connector element. The design allows decreased manufacturing costs because of the decreased complexity of the individual connecting elements. However, this design is lacking, because although it permits struts to be connected to the connector connector element in "three dimensions", it allows connection of the struts only in planes which are at right angles to one another.

U.S. Pat. No. 3,252,287 to Suzuki discloses a T-shaped concrete block which may be connected to a similarly shaped block to form a three dimensional block having a hexpodal shape. When connected together, the two blocks have elements extending in three different planes, which are at right angles to one another.

U.S. Pat. No. 4,892,484 to Brown et al. discloses an interconnecting toy in which the connecting elements preferably have struts radially extending from a central stabilizing section at 90° to one another.

SUMMARY OF THE INVENTION

In accordance with the present invention, there is provided a connector element comprising:

(a) first and second interengagable elements, each of the first and second elements having a first portion and at least one arm extending outwardly from the respective first portion, the arms of the first and second elements positioned in different planes when the first and the second elements are interengaged, (b) a first locking member defined by the interengagement of the first portions of the first and second elements; and, (c) a second locking member, the second locking member shaped to be lockingly received in the first locking member.

In one embodiment, the second locking member has at least one arm, the arm of the second locking member being in a different plane from the planes in which the arms of the first and second elements are positioned when the second locking member is received in the first locking member.

In a further embodiment, the first and second elements are planar. The first portions are configured to position the at least one arm of each of the first and second elements in first and second planes when the first and second elements are interengaged.

In a further embodiment, the first and second elements are identically shaped, and each have a plurality of radially extending arms. The first and second planes may be radially displaced 60° from each other. Additionally, the second locking member may have two additional radially extending arms. The second locking member may extend in a third plane that is radially displaced from the first and second planes whereby the third plane is radially displaced 60° from the first and second planes.

The present invention provides advantages over known connector devices in that manufacturing costs are reduced since two of the elements may be identical (and essentially flat), and yet provides a connecting device which may have more connecting arms in more planes than was previously available.

BRIEF DESCRIPTION OF THE DRAWINGS

These and other advantages of the present invention will be more fully and completely understood through a consideration of the following description taken together with the accompanying drawings of a preferred embodiment of the invention in which.

DETAILED DESCRIPTION OF THE PREFERRED EMBODIMENT

Figure 1:
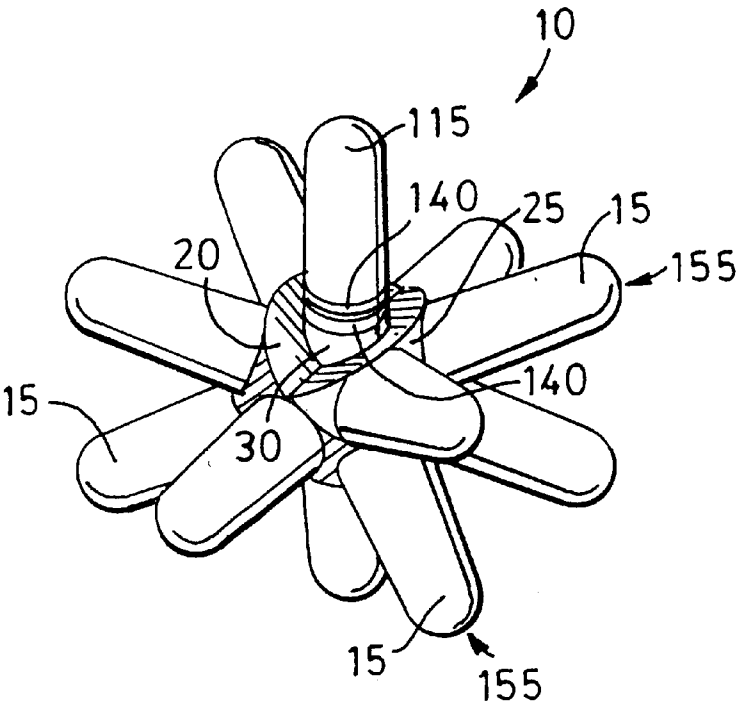
FIG. 1 is a perspective view of an assembled connector device made in accordance with a preferred aspect of the present invention.
Figure 3:
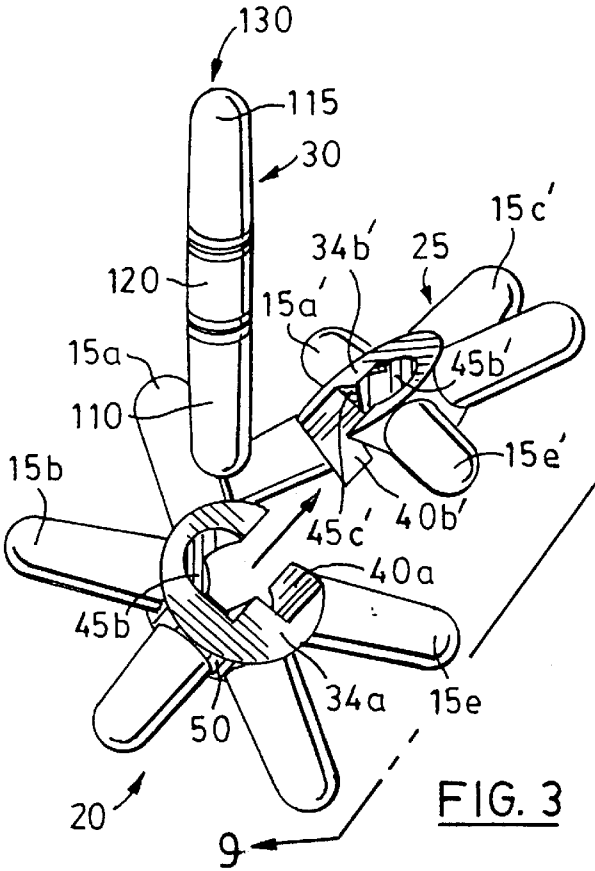
FIG. 3 is an exploded view of the connector shown in FIG. 1 in full disassembled relationship.
Figure 7:
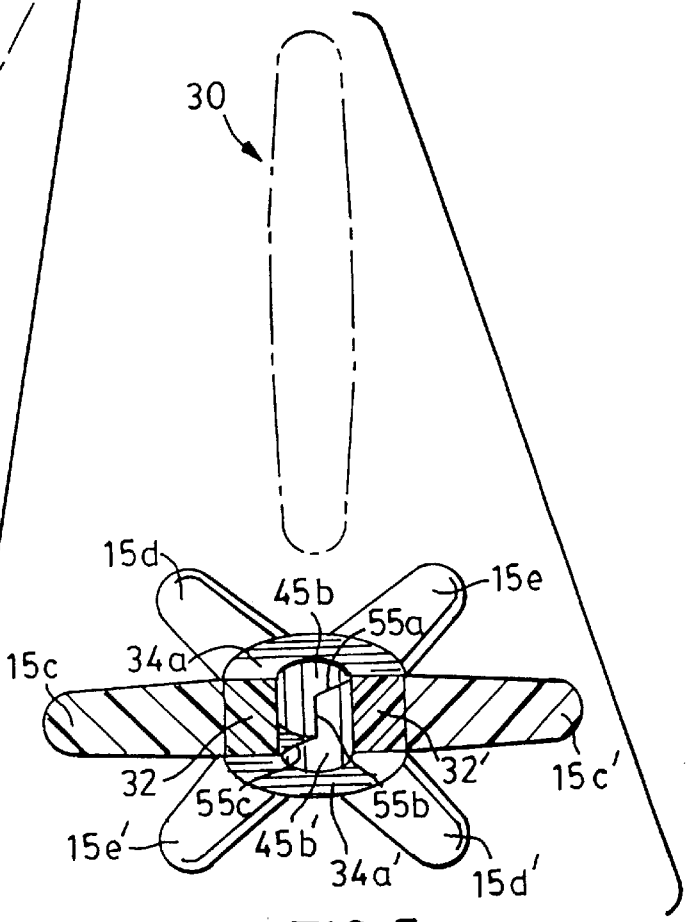
FIG. 7 is a cross section along the line 7—7 in FIG. 2.

Referring to FIG. 1, there is shown an assembled connector device made in accordance with a preferred aspect of the present invention, referred to generally by reference numeral 10. When assembled, connector device 10 has a plurality of radially extending arms 15 which are positioned in a multiplicity of planes. As shown in FIG. 3, connector device 10 comprises two connecting elements 20 and 25 which are secured together by a locking element 30. The same reference numerals are used to designate the same features of connecting elements 20 and 25 except that the features of connecting element 25 are distinguished by the addition of the prime mark, i.e. (').

Figure 4:
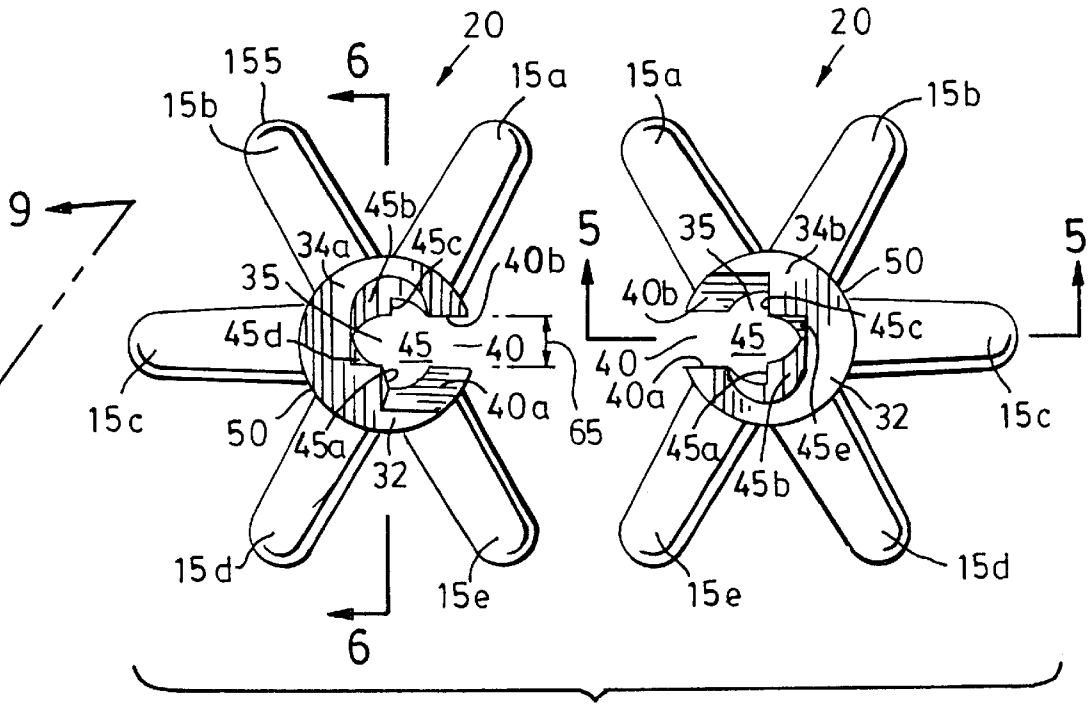
FIG. 4 are top and bottom plan views of a locking element shown in FIG. 1.

Referring to FIG. 4, there is shown the top and bottom plan views of a single connecting element 20. The connecting element 20 has a first portion 32 and at least one arm 15 extending outwardly therefrom. First portion 32 is generally planar and may have be generally disk like or cylindrically shaped with an exterior perimeter 50. Cut out portion 35 is provided in first portion 32 so as to define an opening in first portion 32. Preferably a plurality of radially extending arms 15 surround the connecting element 20. Preferably, each of arms 15 is of the same length. However, in one embodiment, arms 15 may be of varying length. Preferably, each arm 15 is at least slightly tapered from its minimum size at its tip 155 to its maximum size where it abuts exterior perimeter 50.

Figure 6:
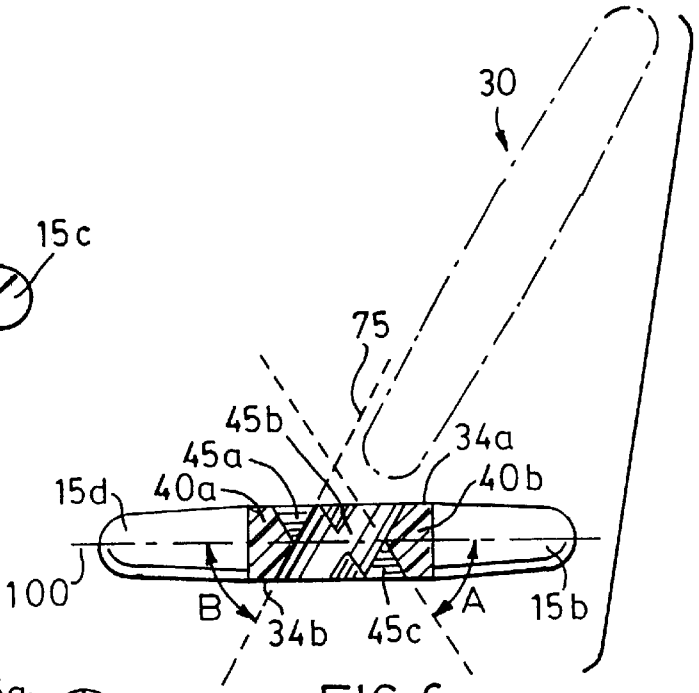
FIG. 6 is a cross section along the line 6—6 in FIG. 4.

The connecting element 20 and the radially extending arms 15 preferably define a single plane, marked as line 100 in FIG. 6, so that the connecting element 20 and arms 15 have a generally flat or planar profile. This profile is beneficial in that it may reduce manufacturing costs, since the structure is essentially two dimensional (the structure preferably being relatively thin), and less complicated than if the arms 15 extended from the element 20 in more than one dimension. In the preferred embodiment, the element 20 has five radially extending arms 15, spaced about the connecting element 20. The arms 15 are preferably equally spaced along exterior perimeter 50. More preferably, they are equally spaced about the connecting element 20 as if there were in fact six arms with one of the arms missing. According to this embodiment, all of the arms are radially spaced from one another by approximately 60° (i.e. the angle between pairs of arms 15*a* and 15*b*, 15*b* and 15*c*, 15*c* and 15*d*, 15*d* and 15*e* is 60°) except for arms 15*a* and 15*e* which are radially spaced apart from one another by 120°. It will be appreciated that any number of desired arms 15 having any desired spacing may be positioned around exterior perimeter 50.

Connecting element 20 has a first portion 32 which is configured to engage the first portion of connecting element 25. The interengagement of the first portions 32 of connecting elements 20 and 25 define a first locking member which is shaped to lockingly receive locking element 30. Preferably, locking element 30 is releasably lockingly engaged in the first locking member. The first portions 32 are preferably configured to position arms 15 of connecting element 20 and arms 15 of connecting element 25 in different planes when the first portions 32 are interengaged.

Figure 5:
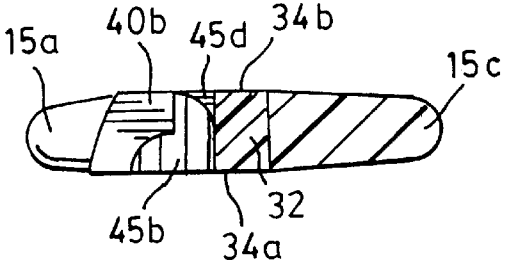
FIG. 5 is a cross section along the line 5—5 in FIG. 4.
Figure 8:
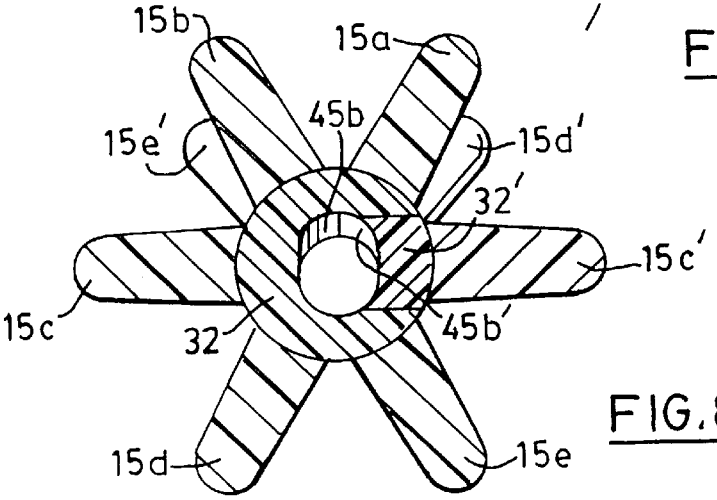
FIG. 8 is a cross section along the line 8—8 in FIG. 2.

Referring to FIG. 4, first portion 32 has a top surface 34*a* and an opposed bottom surface 34*b*. Exterior perimeter 50 extends around first portion 32 so as to preferably define the substantial portion of a circle leaving a gap 40 having sides 40*a* and 40*b*. Preferably exterior perimeter 50 extends around first portion 32 so as to define at least a sufficient amount of a circle so that locking element 30 may not pass therethrough. The cut out portion 35 of connecting element 20 defines a central opening 45 having interior surfaces constructed to form engagement surfaces with cut out portion of connecting element 25. As shown in the preferred embodiment, connecting element 20 preferably has interior surfaces 45*a*, 45*b*, 45*c*, 45*d* and 45*e* extending between sides 40*a* and 40*b* (see FIGS. 4, 5 and 6).

Interior surfaces 45*a*, 45*b*, 45*c*, 45*d* and 45*e* and sides 40*a* and 40*b* are angularly offset from the plane defined by connecting element 20 (i.e. line 100). As shown in FIG. 6, interior surfaces 40*a* and 40*b* are preferably parallel to each other and are preferably offset by an angle A from the plane defined by the connecting element 20 and the arms 15. In the preferred embodiment, the angle A is about 60°. Sides 40*a* and 40*b* define a pair of opposed surfaces which are shaped to abut the respective top and bottom surfaces of connecting element 25. Accordingly side 40*a* may extend from gap 40 of the connecting element 20 part way along the interior of first portion 32 to interior surface 45*a* of connecting element 20. Similarly, side 40*b* may extend from gap 40 of the connecting element 20 part way along the interior of first portion 32 to interior surface 45*c* of connecting element 20. Gap 40 preferably has a width 65 of the same approximate size as the thickness of the connecting element 25. Interior surfaces 45*a* and 45*c* are preferably parallel and in a plane that is preferably transverse to the plane defined by sides 40*a* and 40*b*.

Accordingly, when connecting elements are inserted into each other, sides 40*a* and 40*b* of connecting element 20 abut upper and lower surfaces 34*a*' and 34*b*' of connecting element 25. Similarly sides 40*a*' and 40*b*' of connecting element 25 abut upper and lower surfaces 34*a* and 34*b* of connecting element 20. Further, interior surface 45*c* of connecting element 20 will abut interior surface 45*c*' of connecting element 25 and interior surface 45*a* of connecting element 20 will abut interior surface 45*a*' of connecting element 25. As shown in FIG. 6, the abutment of side 40*b* and lower surface 34*b*' is shown as line 55*a*, the abutment of surfaces 45*c* and 45*c*' is shown by line 55*b* and the abutment of side 40*b*' and lower surface 34*b* is shown as line 55*c*.

The interior surface 45*b* of the cut out portion 35 preferably defines a partial bore (which is preferably semi-cylindrical) which extends through first portion 32 of the connecting element 20. The interior surface 45*b* is inset from the exterior perimeter 50 of the connecting element 20 and is positioned between sides 40*a* and 40*b*. The axis 75 of the bore is preferably angularly offset from the plane defined by the connecting element 20 by an angle B (see FIG. 6). Preferably, angle B is equal but opposite to the angle A, and is approximately 60°. While the bore may have any desired shape, in the preferred embodiment, the interior surface 45*b* is smooth, and generally arcuate, and, most preferably, forms one half of a cylindrical bore. As will be appreciated, the angles A and B may be varied, but in the preferred embodiment, the angles A and B are the same, and are each approximately 60°.

The connecting element 25 may be similarly shaped to the connecting element 20. Although not shown it will be appreciated that the connecting element 25 must be complimentary to connecting element 20 and may be the same as the connecting element 20 which has been described. For example, the connecting element 25 also has a first portion 32' having a central cut out portion 35', with sides 40*a*' and 40*b*' and interior surfaces 45*a*', 45*b*', 45*c*', 45*d*', and 45*e*' as previously described. Interior surfaces 45*b*' of connecting element 25 must be offset at a complimentary angle to interior surfaces 45*b* of connecting element 20 so that the two connecting elements may interengage. A similar offset may be required for interior surfaces 45*a*', 45*c*', 45*d*', and 45*e*'. In the most preferred embodiment, the connecting element 25 is identical in all respects to the connecting element 20, and the angles A and B in connecting element 25 are the same as the angles A and B in the connecting element 20, which are preferably approximately 60°. In other words, connector device 10 may be assembled from two identically shaped connectors 20 and locking element 30.

One advantage of the present design is that when two identical connecting elements 20, 25 are used, the two connecting elements may be assembled together and secured in place with a third locking element. In this fashion, the gap 40 of each connecting element 20, 25 has the same width as the thickness of the other connecting element 20, 25. Therefore, a pair of connecting elements 20, 25 may cooperate to interengage one another, as shown in FIG. 3.

When the two connecting elements 20 and 25 are interengaged, interior surfaces 45*a*, 45*b* and 45*c* of connecting element 20 are in contact with interior surfaces 45*a*', 45*b*' and 45*c*' on the connecting element 25, to define a first locking member. In a preferred configuration, the first locking member has cylindrical bore defined by the semi-cylindrical bores defined by each interior surface 45*b* and 45*b*' of connecting elements 20, 25. The axis of the bore is axis 75. The first locking member is designed to receive a second locking member, namely locking element 30, to secure the connector device 10 together. Axis 75 is preferably angularly displaced from the planes defined by arms 15 of connecting elements 20 and 25, and is preferably displaced by an angle of approximately 60°.

The locking element 30 may be any locking device which is capable of securing together the two connecting elements 20 and 25. Accordingly, locking element 30 has a shape which is complimentary to the shape of the first locking member. In the preferred embodiment, locking element 30 is an elongate, generally cylindrical rod having two end sections 110, 115 and a middle section 120. The middle section 120 of locking element 30 is shaped to match the shape of the interior surfaces 45*b* and 45*b*' of the connecting elements 20 and 25 which form a bore when interengaged. Therefore, in the preferred embodiment, the middle section 120 is preferably cylindrical in shape, and has an outer diameter corresponding to the diameter of the bore, so that the middle section of locking element 30 may be received in the bore. More preferably, the middle section 120 has an outer diameter slightly smaller than the diameter of the bore, so that locking element 30 may be received in the bore for rotation of locking element 30 about the axis of the bore. Alternately, the middle section 120 may have an outer diameter slightly larger than the diameter of the bore, so that the middle section of locking element 30 may be lockingly received in the bore.

The two end sections 110, 115 of locking element 30 are preferably generally cylindrical in shape. Preferably at least one of the end sections 110, 115 is at least slightly tapered from its minimum size at its tip 130 to its maximum size where it is received in the middle section 120. In this manner, at least one of the end sections 110, 115 may be inserted through the bore, so that the middle section 120 engages the bore to secure the two connecting elements 20 and 25 together. This relationship may be seen in FIG. 3. In the preferred embodiment, each of the end sections 110, 115 are similarly sized and shaped, so as to be interchangeable (so that either end section may be inserted through the bore).

The two end sections 110, 115 preferably have a length approximately equal to the length of the arms 15, and are tapered in a similar manner. In this fashion, the end sections of the locking element may also act as arms to receive an interconnecting element, which will be subsequently discussed.

Figure 2:
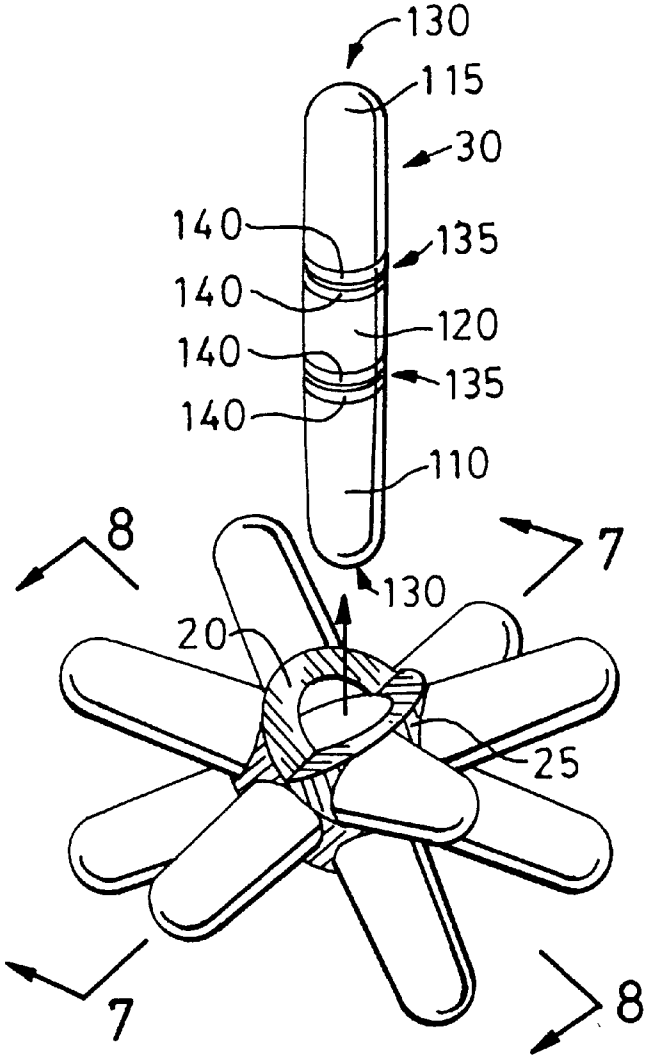
FIG. 2 is a partially exploded view of the connector shown in FIG. 1.

In the preferred embodiment, the middle section 120 and the end sections 110, 115 are separated from one another by locking detent means 135. The locking detent means 135 may be any means which secures the middle section 120 of locking element 30 within the first locking member. As shown in FIG. 2, the locking detent means may comprise one or more ridges 140 located at the junction between the middle section 120 and each end section 110, 115. The ridges 140 surround locking element 30, and protrude from the surface of locking element 30 sufficiently to prevent locking element 30 from inadvertently being dislodged from the first locking member. At the same time, the ridges 140 do not prevent locking element 30 from being dislodged from the bore if it is desired by the user to disassemble the connecting device. In the preferred embodiment, the locking detent means comprises a pair of spaced ridges 140 located at the junction of the middle section 120 and each end section 110, 115, as shown in FIG. 2.

The length of the middle section 120 is preferably such that, when the connecting device is assembled as shown in FIG. 1, the ridges 140 at each junction between the middle section 120 and the end sections 110, 115 are located just outside of the bore. In this manner, the ridges 140 prevent locking element 30 from moving undesirably when locking element 30 is in position within the first locking member.

The connector 10 of the present invention may be utilized as a part of a construction toy for children, in which a multiplicity of connectors may be joined together by interconnecting elements to form a structure. For example, the connectors may be joined together with interconnecting members. Alternately, it may be used as an isometric space fame.

Figure 9:
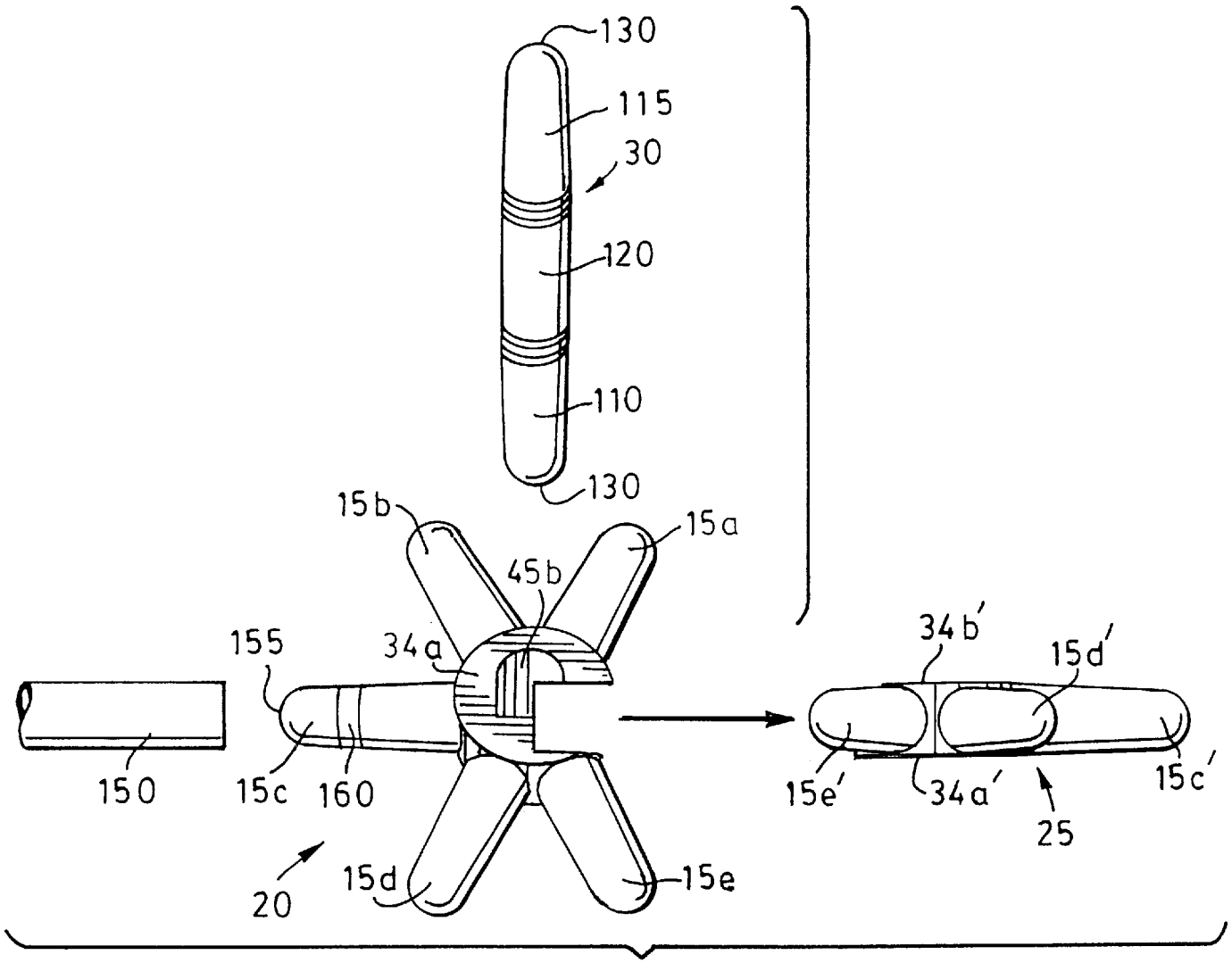
FIG. 9 is a cross section along the line 9—9 in FIG. 3.

In FIG. 9, a preferred manner of connection of an interconnecting member 150 to an arm 15 is shown for a single connecting element 20. Interconnecting members 150 may be of any suitable construction for use in joining the connecting devices. For example, the interconnecting members may be in the form of hollow rods such as straws. In this case, the hollow interior portion of the rods has a diameter adapted to fit over arm 15 of the connecting devices. In this design, the hollow interconnecting members 150 preferably have an interior diameter slightly smaller that the maximum diameter of the arm 15. In this fashion, when the interconnecting members 150 are slid over arms 15, the interconnecting members 150 are snugly held in place by friction, and can be separated only through intention of the user.

In another embodiment, each arm 15 may additionally include a protrusion 160 located at approximately the midpoint of arm 15. The protrusion 160 may be in the form of a raised ridge extending around arm 15 (FIG. 9). It will be appreciated that the additional protrusion 160 on each arm 15 will aid in the retention of the interconnecting members 150 on the arms 15, by providing additional friction between the arm 15 and the interconnecting element 150. The protrusion 160 is preferably of a size which allows relative ease in securing an interconnecting element 150 to the arm 15, yet aids in preventing inadvertent disengagement between the two.

The manner of connection between the interconnecting members 150 and the arms 15, 110 and 115 may be any suitable design. Any configuration known in the art may be used. Further, arms 15, 110 and 115 may be configured to engage each other as is also known in the art. Further, differing connecting means may be provided on the ends of arms 15, 110 and 115. For instance, the arms 15, 110 and 115 could be in the form of cups, suitable to securely receive therein solid rods (not shown). As will be appreciated, there are numerous possibilities for connection of the interconnecting members and the arms 15, 110 and 115 which may be suitable.

The different parts of the present invention may be manufactured from any suitable material. However, the preferred material of manufacture is from a plastic material, which can be injection moulded. It will be appreciated, however, that numerous different materials may be utilized.

While the connector as described herein may be assembled and disassembled (as shown in FIG. 9), it will be understood that this is a feature which is not necessary to the contemplated invention. In certain situations, it may be desirable to assemble the connector from its various components in a manner which prevents later disassembly. This is particularly so for applications in which the connector is to be used as a part of a child's construction toy. In this situation, it would be undesirable for the connector to be easily disassembled, since small independent parts could be hazardous to a child (through accidental swallowing, for example). For example, connectors 20, 25 and locking element 30 may be fused together by any process known in the art, such as by a welding process or by glue, so that once assembled, connector device 10 remains a unitary body.

It will be clear that the present invention provides an improvement over the prior art in that it provides a three dimensional connecting device made from a minimum of differently shaped parts (two i.e. connecting elements 20 and 25 which may be the same and connecting element 30), which may be joined together by interconnecting elements in a multiplicity of different planes.

Figure 10:
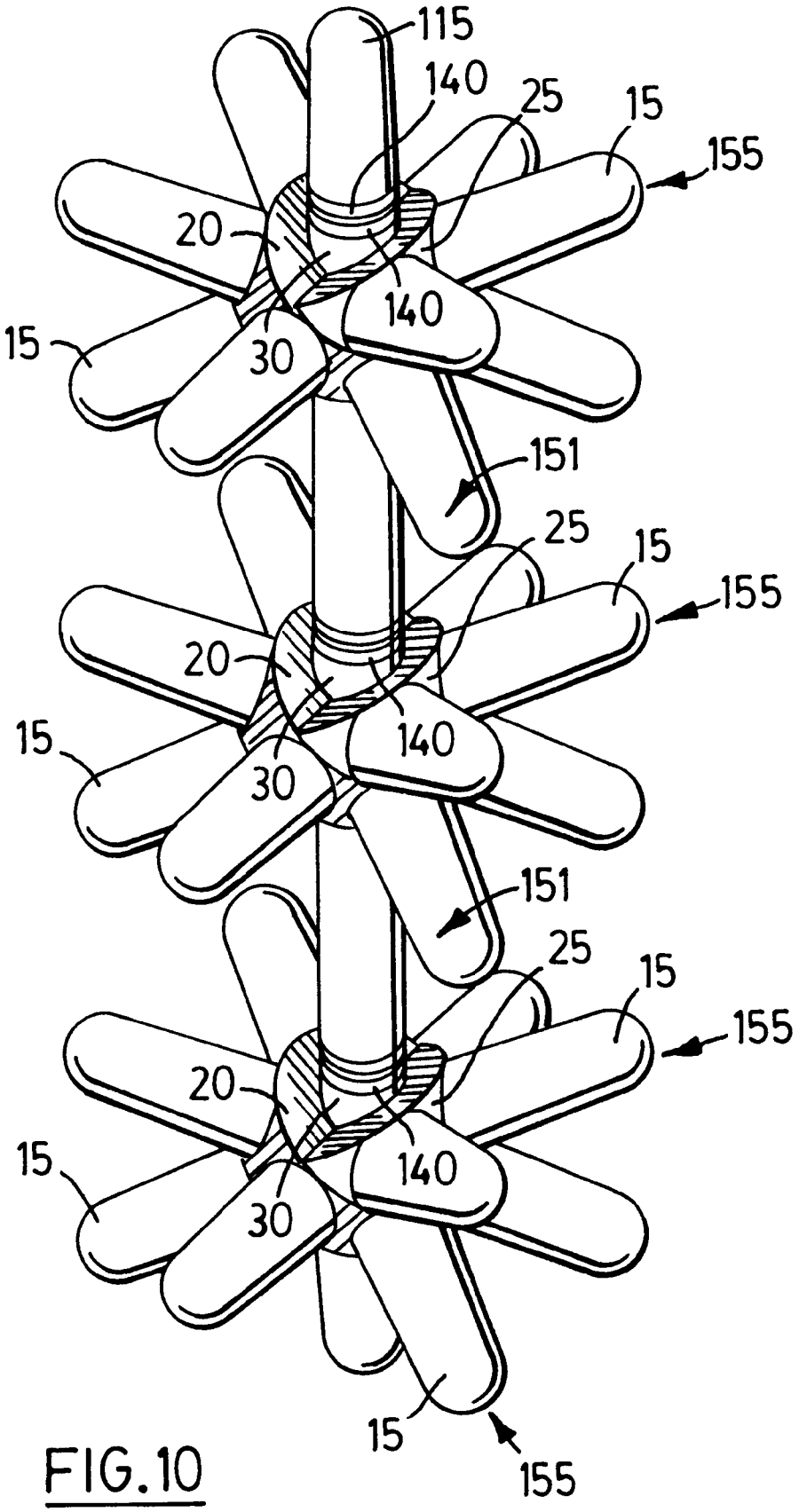
FIG. 10 is a perspective view of an assembled connector device made in accordance with another embodiment of the present invention.

It will be appreciated that various changes and modifications may be made within the spirit of the invention, and all such changes and modifications are within the scope of the attached claims. In one embodiment, locking element 30 may be sized to receive thereon a plurality of pairs of connecting elements 20 and 25 which may received on middle section 120 as shown in FIG. 10.

I claim:

1. A connector element comprising:

(a) first and second interengagable elements, each of said first and second elements having a first portion and at least one arm extending outwardly from the respective first portion, said arms of said first and second elements positioned in different planes when said first and said second elements are interengaged;

(b) a first locking member defined by the interengagement of said first portions of said first and second elements, said first locking member having a longitudinally extending opening defining a first diameter; and (c) a second locking member lockingly received in said first locking member, said second locking member having at least one portion having an outer diameter, the outer diameter of the at least one portion being slightly larger than the first diameter.

2. The connector as claimed in claim 1 wherein said second locking member has at least one arm, said arm of said second locking member being in a different plane from the planes in which said arms of said first and second elements are positioned when said second locking member is received in said first locking member.

3. The connector as claimed in claim 2 wherein said first and second elements are planar, said first portions configured to position said at least one arm of each of said first and second elements in different planes when said first and second elements are interengaged.

4. The connector as claimed in claim 3 wherein said first portion of said first element has a first engagement surface which is positioned at an angle with respect to the plane defined by said first element and said first portion of said second element has a second engagement surface which is positioned at an angle with respect to the plane defined by said second element.

5. The connector as claimed in claim 3 wherein each of said first portions has abutment surfaces positioned at an angle with respect to the plane defined by said its respective element, and said opening extends at an angle with respect to the planes defined by said first and second elements.

6. The connector as claimed in claim 3 wherein each of said first and second elements has a plurality of arms spaced around the respective first portion in a first radial direction, said second locking member having a pair of opposed arms whereby, when said connector is assembled, said arms of said first and second elements and said arms of said second locking member are spaced around said first locking member in a second radial direction.

7. The connector as claimed in claim 3 wherein said first and second elements are identical.

8. The connector as claimed in claim 1 wherein said opening comprises a longitudinally extending bore and said second locking member comprises a longitudinally extending member having a central portion the diameter of said central portion being smaller than the diameter of said longitudinally extending bore, whereby the second locking member is also rotatably mounted within the first locking member.

9. The connector as claimed in claim 1 wherein said opening comprises a longitudinally extending bore and said second locking member comprises a longitudinally extending member having a central portion, said second locking member further having at least one raised surface on either side of said central portion sized to resist movement of said second locking member out of engagement with said first locking member.

10. The connector as claimed in claim 1 wherein said second locking member comprises a longitudinally extending member which is sized to be lockingly received in a plurality of said first locking members.

11. A connector element for connecting interconnecting members together comprising:

(a) first and second interengagable elements, said first element having a first portion and a first plurality of arms extending outwardly from the first portion in a first plane and a first abutment surface extending at an angle other than 90 degrees to the first plane and said second element having a second portion and a second plurality of arms extending outwardly from the second portion in a second plane and a second abutment surface extending at an angle other than 90 degrees to the second plane, at least some of said arms being adapted for releasably lockingly engaging an interconnecting member, said first and said second abutment surfaces cooperating so that when said first and second elements are interengaged, said first plane intersects said second plane at an angle other than 90°;

(b) a first locking member defined by the interengagement of said first and second portions of said first and second elements; and (c) a second locking member shaped to be lockingly received in said first locking member.

12. The connector as claimed in claim 11 wherein said second locking member has a longitudinally extending axis and at least one arm, said arm being adapted for releasably lockingly engaging an interconnecting member, the longitudinally extending axis intersects the first and second planes at an angle other than 90 degrees when said second locking member is received in said first locking member.

13. The connector as claimed in claim 12 wherein said first and second elements are planar, said first and second portions configured to position said first and second plurality of arms in different planes when said first and second elements are interengaged.

14. The connector as claimed in claim 13 wherein said first locking member comprises a slot extending at an angle with respect to the first and second planes.

15. The connector as claimed in claim 14 wherein said second locking member comprises a longitudinally extending member having a central portion having an outer diameter and arms positioned on either side of said central portion and said first locking member comprises an opening for receiving the longitudinally extending member having a first diameter, such that the outer diameter is slightly larger than the first diameter, whereby one of the first and second locking members, whereby the second locking member is lockingly received in said first locking member.

16. The connector as claimed in claim 15 wherein said opening comprises a longitudinally extending bore and said second locking member comprises a longitudinally extending member having a central portion, said second locking member having at least one raised surface on either side of said central portion sized to resist movement of said second locking member out of engagement with said first locking member.

17. The connector as claimed in claim 13 wherein said first and second elements are identical.

18. The connector as claimed in claim 11 wherein said second locking member comprises a longitudinally extending member which is sized to be lockingly received in a plurality of said first locking members.

* * * * *